US008309191B2

(12) United States Patent
Wang et al.

(10) Patent No.: US 8,309,191 B2
(45) Date of Patent: Nov. 13, 2012

(54) PACKAGED PRODUCT FOR PROTECTING LIGHT-SENSITIVE LIQUID COMPOSITION

(75) Inventors: Ping Wang, Beijing (CN); Akiko Taneko, Nishinomiya (JP); Taichi Kodani, Kobe (JP); Jean-Luc Azzani, Waterloo (BE)

(73) Assignee: The Procter & Gamble Company, Cincinnati, OH (US)

( * ) Notice: Subject to any disclaimer, the term of this patent is extended or adjusted under 35 U.S.C. 154(b) by 106 days.

(21) Appl. No.: 12/939,380

(22) Filed: Nov. 4, 2010

(65) Prior Publication Data

US 2011/0100857 A1 May 5, 2011

(51) Int. Cl.
*B32B 1/08* (2006.01)

(52) U.S. Cl. ..... 428/36.7; 206/524.3

(58) Field of Classification Search ..... 428/36.4, 428/35.7, 36.7, 36.92; 206/524.1, 524.2, 206/524.3, 524.4, 524.6; 215/12.1, 12.2
See application file for complete search history.

(56) References Cited

U.S. PATENT DOCUMENTS

| | | | | |
|---|---|---|---|---|
| 1,095,313 | A * | 5/1914 | Davids | 215/365 |
| 3,629,595 | A * | 12/1971 | Babunovic et al. | 250/223 B |
| 4,463,861 | A * | 8/1984 | Tsubone et al. | 215/12.2 |
| 4,797,244 | A * | 1/1989 | Sauer | 264/266 |
| 5,750,226 | A * | 5/1998 | Macauley et al. | 428/36.4 |
| 5,806,681 | A * | 9/1998 | Frisk | 206/524.3 |
| 6,117,506 | A * | 9/2000 | Graboski et al. | 428/35.9 |
| 6,797,751 | B2 * | 9/2004 | Andrews et al. | 524/94 |
| 7,258,786 | B2 * | 8/2007 | Patton et al. | 210/198.1 |
| 7,288,583 | B2 * | 10/2007 | Andrews et al. | 524/94 |
| 2009/0166447 | A1 * | 7/2009 | Escoto et al. | 239/302 |
| 2011/0100857 | A1 * | 5/2011 | Wang et al. | 206/524.1 |

FOREIGN PATENT DOCUMENTS

| | | | |
|---|---|---|---|
| CN | 1532121 | A | 9/2004 |
| CN | 1631739 | A | 6/2005 |
| CN | 2749809 | Y | 1/2006 |
| JP | 2007-31900 | A | 2/2007 |

OTHER PUBLICATIONS

International Search Report and Written Opinion from the International Searching Authority, mailed on Aug. 19, 2010, International Application No. PCT/CN2009/001232, 7 pages.

* cited by examiner

*Primary Examiner* — N. Edwards
(74) *Attorney, Agent, or Firm* — Gary J. Foose

(57) ABSTRACT

A packaged product. The package has a plastic container and a light-sensitive liquid composition contained in the plastic container. The container has a plastic container for protecting a light-sensitive liquid composition from light. The container has: i) a top; ii) a bottom opposing to the top; iii) a first layer extending from the top to the bottom, wherein the first layer is non-opaque; and iv) a second layer superposed with a part of the first layer, wherein the second layer has a blocking agent. The container has a non-superposed area covering the bottom. In the non-superposed area the first layer is not superposed with the second layer. The non-superposed area has a height h from about 2 mm to about 50 mm.

14 Claims, 4 Drawing Sheets

PACKAGED PRODUCT FOR PROTECTING LIGHT-SENSITIVE LIQUID COMPOSITION

FIELD OF THE INVENTION

The present invention relates to a packaged product for protecting a light-sensitive product.

BACKGROUND OF THE INVENTION

Designs for containers of consumer products, especially liquid products, such as fabric and home care products, hair care products, health care products, and skin care products are carefully developed to draw users' attention. Transparent or translucent liquid containers show the inside product's color. Transparent or translucent containers may allow users to see into the container to judge how much product remains, and whether or not they need to purchase a new one. Therefore, a transparent or translucent container are typically preferred.

However, if the container is transparent or translucent, it allows light to pass through. There are several light-sensitive ingredients, such as a fabric softening active, a bleach, an enzyme, and the like. Such a light-sensitive ingredient can provide benefits such as better softening, better cleaning, better fragrance, and the like. If the container contains such a light-sensitive product inside, the product may decompose, discolor and/or denature. Therefore it may be difficult to meet both aesthetics and stability control at the same time with a light-transmissible, i.e., transparent or translucent, container. For light-sensitive compositions, it would be better if the container protects the liquid composition from damaging light.

One technique to protect such light-sensitive materials is to wrap the container with a decorated shrink sleeve. If the container is wrapped with a shrink sleeve, the product inside the container may be protected from external light. A shrink sleeve may also add aesthetic decorations to the container, but it requires an extra step in the manufacturing process. Further, the shrink sleeve is a separate material from the container and so may not be environmentally preferred.

Thus, there exists a need for an improved product and container to provide aesthetics and protect a light-sensitive liquid product from external light.

SUMMARY OF THE INVENTION

The present invention relates to a packaged product. The packaged product contains a plastic container and a light-sensitive liquid composition contained in the plastic container. The plastic container contains a top, a bottom opposing to the top, a non-opaque first layer extending from the top to the bottom; and a second layer superposed with a part of the first layer. The second layer comprises a blocking agent that blocks the wavelength of light, $\lambda$, to which the light-sensitive ingredient is sensitive to. The container has a non-superposed area covering the bottom. In the non-superposed area the first layer is not superposed with the second layer. The non-superposed area extends from the bottom to a height h of from about 2 mm to about 50 mm.

Without intending to be bound by theory, it is believed that as the container comprises a blocking agent, the container can effectively protect a light-sensitive liquid composition from light radiation. As the bottom area of the container is not covered with the second layer, the liquid composition inside can be viewed from the outside. As a result, the present invention provides good aesthetics and functionality while also protecting the light-sensitive liquid composition. As a result, the aesthetics allows one to view the contents from the bottom and still protects the composition from light during storage and/or on the shelf.

The container of the present invention may protect the liquid composition therein from external stimulus such as ultraviolet (UV) light. When the second layer is pigmented and the second layer's thickness gradually decreases from the top to the bottom in the height direction, it has a gradation appearance, i.e., that one color is blending into another, or that one color gradually becomes less intense. Such an appearance may be preferred for some compositions and by some consumers.

BRIEF DESCRIPTION OF THE DRAWINGS

The present invention is more readily understood by the attached non-limiting drawings, where.

The figures herein are not necessarily drawn to scale.

DETAILED DESCRIPTION OF THE INVENTION

As used herein, "comprise" means that other elements and/or other steps which do not affect the end result can be added. This term encompasses the terms "consisting of" and "consisting essentially of". Unless specifically stated, all ratios, percentages, etc. are by weight of the final packaged product. Unless specifically stated, the ingredients and/or equipment herein are believed to be widely available from multiple worldwide suppliers/sources.

While the specification concludes with the claims particularly pointing and distinctly claiming the invention, it is believed that the present invention will be better understood from the following description.

The present invention relates to a packaged product for protecting a light-sensitive composition, especially a liquid composition. The packaged product comprises a container and a light-sensitive liquid composition therein. The plastic container contains a top, a bottom opposing to the top, a non-opaque first layer extending from the top to the bottom; and a second layer superposed with a part of the first layer. The second layer comprises a blocking agent. The light-sensitive composition is sensitive to light of a wavelength, $\lambda$, and the blocking agent blocks light of the wavelength $\lambda$. The container also has a non-superposed area covering the bottom. In the non-superposed area the first layer is not superposed with the second layer. The non-superposed area has a height h of from about 2 mm to about 50 mm.

The present invention will be illustrated by the following figures in more details.

Figure 1:
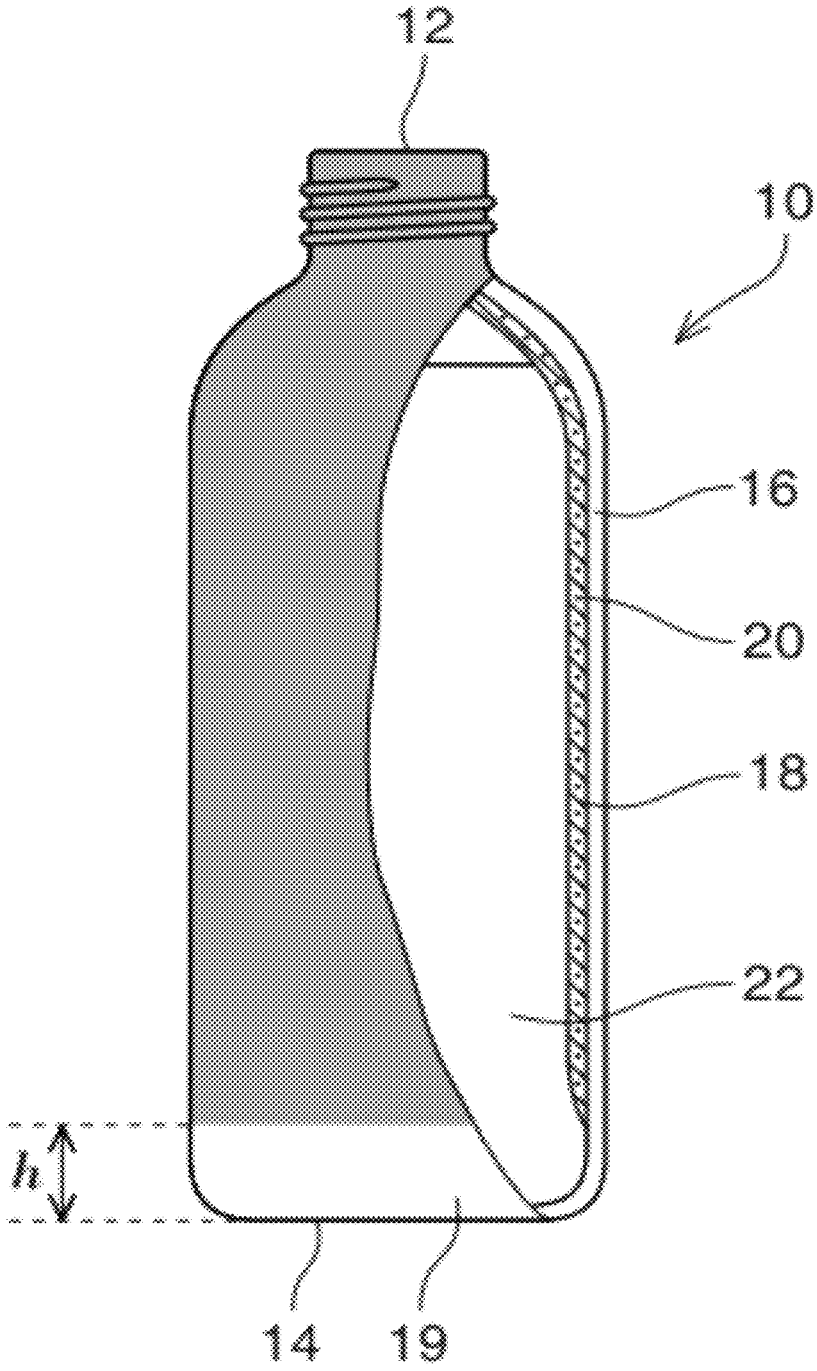
FIG. 1 is a partially cut-away side view of a packaged product according to the present invention.

FIG. 1 is a partially cut-away side view of a packaged product according to the present invention. The packaged product comprises a plastic container and a light-sensitive liquid composition therein. The container, 10, has a top, 12, and a bottom, 14, opposing to the top, 12. The container, 10, has a first layer, 16, and a second layer, 18, superposed with a part of the first layer, 16. In the embodiment of FIG. 1, the second layer, 18, is located inside the first layer, 16. Namely, the first layer, 16, is an outer layer, and the second layer, 18, is an inner layer. Also in FIG. 1, the thickness of the second layer, 18, and the first layer, 16, is substantially the same for most of the bottle, but tapers off as it approaches the bottom, 14. In another embodiment, the thickness of the first layer, 16, and the second layer, 18, may be different from each other.

The first layer, 16, is non-opaque. As used herein, "non-opaque" includes both transparent and translucent. When visible light encounters transparent materials, a high percentage of the light passes through it. When light encounters translucent materials, only a fraction of the light passes through them. In this instance, even if one layer is pigmented, the composition, or even a liquid composition, in the container can be viewed from outside. Transparent and translucent as used herein may encompass colored materials. The transparency/translucency of the first layer is defined by the Haze value, where a higher value indicates greater light transmittance, and a lower value indicates less light transmittance. The first layer, 16, may have a Haze value of from about 0.01% to about 85%, from about 0.1% to about 80%, or from about 0.5% to about 75%. In the embodiment of FIG. 1 where the first layer is made of a transparent polypropylene plastic material, the first layer, 16, has a Haze value of about 4%.

The second layer, 18, contains a blocking agent. As used herein, "blocking agent" refers to an ingredient, typically added to the plastic or resin master batch, which protects the light-sensitive composition from external light radiation, to prevent it from decomposition, discoloration, denaturing, etc. The blocking agent is calibrated to the wavelength, λ, that causes problems for the light-sensitive composition itself. Thus, the blocking agent blocks at least partially any lights that may decompose, discolor and/or denature the ingredients in the liquid composition. The blocking agent may include, e.g., a UV blocking agent and a visible light blocking agent. In FIG. 1, the blocking agent is a UV blocking agent. UV light blocking property may be achieved by adding a UV blocking agent into the material. More particularly, the material of the second layer, 18, may be mixed with a UV blocking agent before molding. In another embodiment, the blocking agent protects from visible light. When a blocking agent which protects from visible light is included in the second layer, the Haze value of the container is lowered, as less visible light passes therethrough. The blocking agent may perform its function by, for example, physically blocking the light, absorbing the light, reflecting the light, and/or refracting light of the particular relevant wavelength.

The container, 10, has a non-superposed area, 19, at the bottom, 14. In the non-superposed area, 19, the first layer, 16, is not superposed with the second layer, 18. The non-superposed area, 19, has a height, h, of from about 2 mm to about 50 mm, from about 5 mm to about 45 mm, from about 8 mm to about 40 mm, or from about 10 mm to about 25 mm, as measured from the bottom, 14. In the embodiment of FIG. 1, h is about 20 mm. Without intending to be limited by theory, it is believed that containers containing a liquid composition are often sold on shelves behind a raised edge portion of a shelf, where the product name, price information, etc. are located. Such a raised shelf edge also prevents the product from sliding off of the shelf and typically has a height no more than about 50 mm. Thus, as the raised edge of the shelf overshadows the bottom of the container, the non-superposed area of the container may still be protected from direct, external light during storage/sale on the shelf. This improves the shelf-life of the product, as compared to when a comparable uniformly transparent or translucent container is used. The second layer, 18, may be superposed with from about 60% to about 98%, from about 65% to about 95%, or from about 70% to about 90% of the first layer, 16. In the embodiment of FIG. 1, the second layer, 18, is superposed with about 80% of the first layer, 16. The bottom, 14, of the container, 10, may receive less light than the top, 12, when a plurality of the containers, 10, are displayed on store shelves. So it is believed that the influence of sunlight and/or interior light on the light-sensitive liquid composition, 22, may be reduced when the non-superposed area, 19, is only at the bottom, 14. At the same time, when a person picks up the container, the composition, 22, in the container, 10, may be visible from the outside, at the non-superposed area, 19, of the container, 10.

In FIG. 1, the second layer, 18, is opaquely pigmented. Therefore, the parts of the container, 10, with the second layer, 18, are opaque. Without intending to be bound by theory, it is believed that some colors such as black, red, blue, yellow, green, orange, gray, white, brown, etc. of the colored second layer, 18, may efficiently protect the light-sensitive liquid composition, 22, from light radiation, depending on the relevant wavelength, λ. When the second layer, 18, is colored translucent or opaque, the second layer, 18, may block the light-sensitive composition, 22, in the container, 10, from decomposition, discoloration and/or denaturing.

The blocking agent may protect the light-sensitive composition from light radiation, by absorbing, refracting and/or reflecting the relevant wavelength of UV light and/or visible light. The blocking agent may include, e.g., a UV blocking agent, a visible light blocking agent, and a mixture thereof. UV blocking agents useful herein include, for example, 2-(2-hydroxy-5-t-butylphenyl)-2H-benzotriazole (Tinuvin PS), 2-hydroxy-4-(octyloxy)-phenyl methanone (Chimassorb® 81), 2-[2-hydroxy-3,5-bis(α,α-dimethylbenzyl)phenyl]-2H-benzotriazole (Tinuvin® 234), 2-(3-t-butyl-5-methyl-2-hydroxyphenyl)-5-chlorobenzotriazole (Tinuvin® 326), 2-(3,5-di-tert-butyl-2-hydroxyphenyl)-5-chloro-2H-benzotriazole (Tinuvin® 327), 2-(2H-benzotriazol-2-yl)-4,6-ditertpentylphenol (Tinuvin® 328), and a mixture thereof. The visible light blocking agent may include, any kind of pigment, dyestuff, colorant, colored material, etc. which blocks or reduces visible light transmission through the container. Therefore, the blocking agent protects the light-sensitive liquid composition, 22, in the container, 10, by intercepting and blocking the UV light before it contacts the light-sensitive liquid composition, 22.

The container, 10, contains a light-sensitive liquid composition, 22, therein. The light-sensitive liquid composition, 22, may include any kind of ingredient which is decomposed, discolored, or denatured by light; e.g., an enzyme, a fabric softening active, a bleach, a perfume, a dye, and a mixture thereof, or an enzyme and a fabric softening active, a bleach and a mixture thereof, or an enzyme, a fabric softening active, and a mixture thereof. The light-sensitive liquid composition may be selected from the group consisting of a detergent, a fabric enhancer, a bleach, a beverage, an air refresher, a shampoo, a hair conditioner, and a mixture thereof; a detergent, a fabric enhancer, a bleach, a shampoo, a hair conditioner, and a mixture thereof; or a detergent, a fabric enhancer, a bleach, and a mixture thereof.

Fabric Softening Active

A first type of fabric softening active comprises, as the principal active, compounds of the formula:

$$\{R_{4-m}—N^{+}—[(CH_2)_n—Y—R^1]_m\}X^{-} \quad (1)$$

wherein each R substituent is either hydrogen, a short chain C1-6, preferably C1-3 alkyl or hydroxyalkyl group, e.g., methyl, ethyl, propyl, hydroxyethyl, and the like, poly (C2-

3-alkoxy), preferably polyethoxy, benzyl, or mixtures thereof; each m is 2 or 3; each n is from 1 to about 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is C12-22, preferably C14-20, with each $R^1$ being a hydrocarbyl, or substituted hydrocarbyl group, and $X^-$ can be any softener-compatible anion, preferably, chloride, bromide, methylsulfate, ethylsulfate, sulfate, and nitrate, more preferably chloride or methyl sulfate.

Non-limiting examples of Compound (1) are N,N-bis(stearoyloxyethyl) N,N-dimethylammonium chloride, N,N-bis(tallowoyloxyethyl) N,N-dimethylammonium chloride, and N,N-bis(stearoyloxyethyl) N-(2 hydroxyethyl) N-methylammonium methylsulfate.

A second type of fabric softening active has the general formula:

$$[R_3N^+CH_2CH(YR^1)(CH_2YR^1)]X^-$$

wherein each Y, R, $R^1$, and $X^-$ have the same meanings as before. Such compounds include those having the formula:

$$[CH_3]_3N^{(+)}[CH_2CH(CH_2O(O)CR^1)O(O)CR^1]C1^{(-)} \quad (2)$$

wherein each $R^1$ is a methyl or ethyl group and preferably each $R^1$ is in the range of $C_{15}$ to $C_{19}$. As used herein, when the diester is specified, it can include the monoester that is present.

A non-limiting example of Compound (2) is the "propyl" ester quaternary ammonium fabric softener active having the formula 1,2-di(acyloxy)-3-trimethylammoniopropane chloride, such as 1,2-di(stearoyloxy)-3-trimethylammoniumpropane chloride.

A third type of fabric softening active has the formula:

(3)

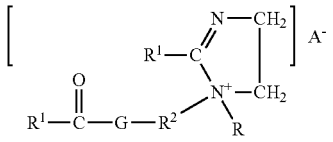

wherein each R, $R^1$, and $A^-$ have the definitions given above; each $R^2$ is a $C_{1-6}$ alkylene group, preferably an ethylene group; and G is an oxygen atom.

A non-limiting example of Compound (3) is 1-methyl-1-stearoylamidoethyl-2-stearoyl imidazolinium methylsulfate wherein $R^1$ is an acyclic aliphatic $C_{15}$-$C_{17}$ hydrocarbon group, $R^2$ is an ethylene group, G is an oxygen atom, and $A^-$ is a methyl sulfate anion.

A fourth type of fabric softening active has the formula:

(4)

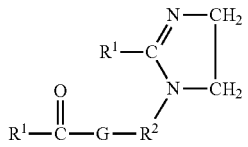

wherein $R^1$, $R^2$ and G are defined as above.

A non-limiting example of Compound (4) is 1-tallowylamidoethyl-2-tallowyl imidazoline wherein $R^1$ is an acyclic aliphatic $C_{15}$-$C_{17}$ hydrocarbon group, $R^2$ is an ethylene group, and G is a NH group.

A fifth type of fabric softening active are condensation reaction products of fatty acids with dialkylenetriamines in, e.g., a molecular ratio of about 2:1, the reaction products containing compounds of the formula:

$$R^1—C(O)—NH—R^2—NH—R^3—NH—C(O)—R^1 \quad (5)$$

wherein $R^1$, $R^2$ are defined as above, and each $R^3$ is a $C_{1-6}$ alkylene group, preferably an ethylene group and wherein the reaction products may optionally be quaternized by the additional of an alkylating agent such as dimethyl sulfate. Such quaternized reaction products are described in additional detail in U.S. Pat. No. 5,296,622, issued Mar. 22, 1994 to Uphues et al., which is incorporated herein by reference.

An example of Compound (5) is the reaction products of fatty acids with diethylenetriamine in a molecular ratio of about 2:1, the reaction product mixture containing N,N"-dialkyldiethylenetriamine with the formula:

$$R^1—C(O)—NH—CH_2CH_2—NH—CH_2CH_2—NH—C(O)—R^1$$

wherein $R^1$—C(O) is an alkyl group of a commercially available fatty acid derived from a vegetable or animal source, and $R^2$ and $R^3$ are divalent ethylene groups.

A sixth type of fabric softening active has the formula:

$$[R^1—C(O)—NR—R^2—N(R)_2—R^3—NR—C(O)—R^1]^+A^- \quad (6)$$

wherein R, $R^1$, $R^2$, $R^3$ and $A^-$ are defined as above.

An example of Compound (6) is a di-fatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$—C(O) is an alkyl group.

A seventh type of fabric softening active are reaction products of fatty acid with hydroxyalkylalkylenediamines in a molecular ratio of about 2:1, the reaction products containing compounds of the formula:

$$R^1—C(O)—NH—R^2—N(R^3OH)—C(O)—R^1 \quad (7)$$

wherein $R^1$, $R^2$ and $R^3$ are defined as above.

An example of Compound (7) is the reaction products of fatty acids with N-2-hydroxyethylethylenediamine in a molecular ratio of about 2:1, the reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source.

An eighth type of fabric softening active has the formula:

(8)

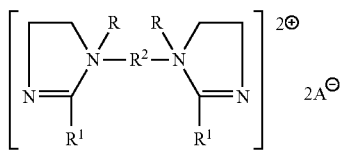

wherein R, $R^1$, $R^2$, and $A^-$ are defined as above.

A non-limiting example of Compound (8) is the di-quaternary compound having the formula:

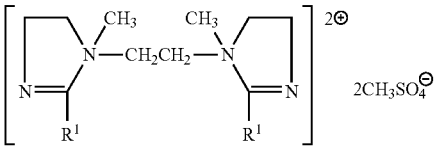

wherein $R^1$ is derived from fatty acid.

It will be understood that combinations of softener actives disclosed above are suitable for use.

Bleach

Suitable bleaches include, for example, peroxygen bleaches. Peroxygen bleaches may be vulnerable to nucleophilic reactions. When the composition receives UV radiation, the energy level is elevated in the ingredients of the composition, and the peroxygen bleaches becomes vulnerable to nucleophilic reactions. Suitable peroxygen bleaches to be used herein are selected from the group consisting of: hydrogen peroxide; water soluble sources of hydrogen peroxide; organic or inorganic peracids; hydroperoxides; diacyl peroxides; and mixtures thereof. As used herein a hydrogen peroxide source refers to any compound that produces perhydroxyl ions on contact with water. Suitable water-soluble sources of hydrogen peroxide for use herein include percarbonates, perborates and persilicates and mixtures thereof.

Enzyme

Enzymes normally comprise proteins, and proteins are typically denatured by high energy light such as UV radiation. In the package of this invention, enzymes would be protected by the present invention from UV radiation. The composition of the present invention can comprise one or more of the following enzymes: proteases like subtilisins from *Bacillus* [e.g. *subtilis, lentus, licheniformis, amyloliquefaciens* (BPN, BPN'), *alcalophilus*], e.g. Esperase®, Alcalase®, Everlase® and Savinase® (Novozymes), BLAP and variants [Henkel], and those described in EP130756, WO 91/06637, WO 95/10591 and WO 99/20726; amylases (α and/or β) like Purafect Ox Am® [Genencor] and Termamyl®, Natalase®, Ban®, Fungamyl® and Duramyl® [all ex Novozymes], and those described in WO 94/02597 and WO 96/23873; cellulases like bacterial or fungal cellulases, e.g. produced by *Humicola insolens*, particularly DSM 1800, e.g. 50 Kda and ~43 kD [Carezyme®], the EGIII cellulases from *Trichoderma longibrachiatum*; lipases like those produced by *Pseudomonas* and Chromobacter groups (e.g. Lipolase R, Lipolase UltraR, Lipoprime R and Lipex R from Novozymes); cutinases [EC 3.1.1.50] and esterases; carbohydrases e.g. mannanase (U.S. Pat. No. 6,060,299), pectate lyase (WO 99/27083) cyclomaltodextringlucanotransferase (WO 96/33267), and xyloglucanase (WO 99/02663).

Perfume

Perfumes, including perfume precursors and/or pro-perfumes, may also be decomposed by light and especially UV light. Accordingly, the invention herein may protect compositions containing these ingredients. Especially vulnerable are perfumes (or their components, precursors, or pro-perfumes) that hydrolyze easily, or that require little activation energy.

The container herein may be formed of a plastic material selected from the group consisting of an olefin-based resin such as polypropylene, polyethylene, polystyrene; a polyester resin such as polyethylene terephthalate (PET); a polyacryl resin, a polyamide resin, a polyvinylchloride resin, an acrylate resin, an ABS resin, an ethylene vinyl alcohol copolymer (EVOH) resin, a nylon resin, a polyvinylidene chloride resin, and a mixture thereof. As for the container, a recycled material may be used, which originates from discarded materials obtained. The inner layer of the superposed layers directly contacts the liquid composition inside. In order to prevent contamination, a recycled material typically is not used for the inner layer, but is usually for the outer layer.

Figure 2:
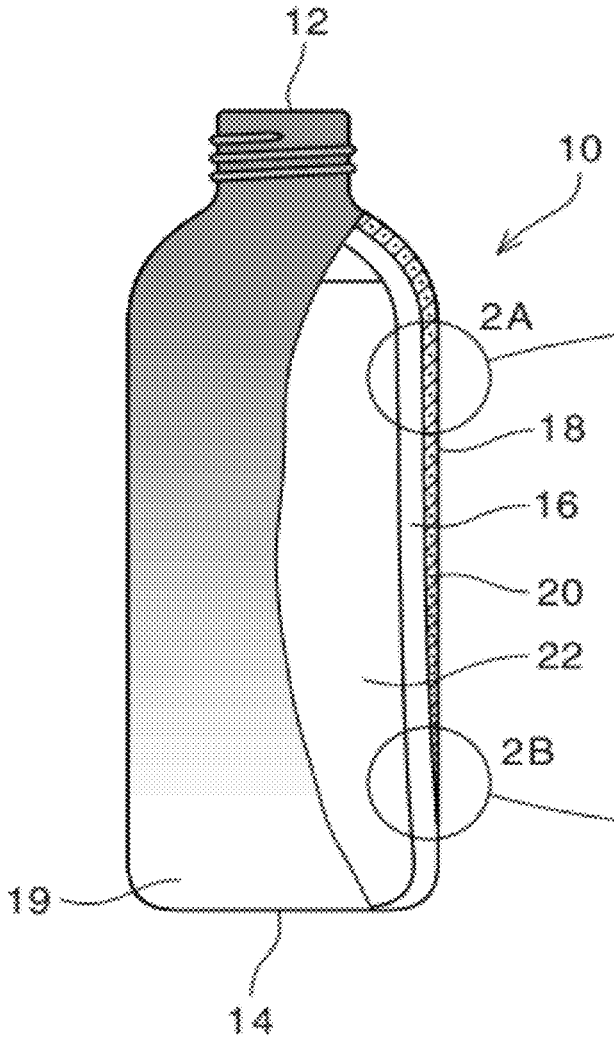
FIG. 2 is a partially cut-away side view of a packaged product according to the present invention.

FIG. 2 is a partially cut-away side view of a packaged product according to the present invention. FIG. 2 is a packaged product having a container which has a gradation texture. In this embodiment, the container, 10, contains a first layer, 16, and a second layer, 18. The first layer, 16, is a non-opaque layer. The second layer, 18, contains a colored blocking agent, 20, and is superposed with a part of the first layer, 16. The second layer, 18, has a second layer thickness, and the second layer thickness decreases from the top, 12, to the bottom, 14, in the height direction. In the embodiment of FIG. 2, the first layer, 16, is an inner layer and the second layer, 18, is an outer layer. The first layer, 16, is not superposed with the second layer, 18, at the bottom, 14, and therefore, the users can see the color of the light-sensitive liquid composition, 22, from the outside, without opening the package at the shop when purchasing. Furthermore during use, the users can see the remaining amount of the light-sensitive liquid composition, 22, from the outside, also without opening the package.

In FIG. 2 the second layer contains a pigment and by varying the thickness of the second layer, a color gradation effect is achieved on the surface of the container. Gradation relates to a change, often a uniform change, of color concentration or hue. In FIG. 2, the color gradually changes from a relatively darker color at the top, 12, to a relatively lighter color or a transparent color at the bottom, 14, due to the thickness decrease of the pigmented second layer (outer layer), 18 and the non-superposed area. This may also be achieved by other methods as well such as decreasing the amount of pigment from the top, 14, toward the bottom, 16. In another embodiment, the effect may be reversed.

The molded package in FIG. 2, is constituted as the container having an improved gradation effect provided by a color tone gradually deepening in a direction parallel to the extruding direction of the molded article, i.e., from the top (mouth portion) toward the bottom, thereby remarkably improving the aesthetic appearance of the container.

In molding such a bi-layered container, it is possible to use a multi-layer co-extrusion die to simultaneously or sequentially merge different resin materials.

In this respect, it is possible to adjust the color concentration in a superposed and molded body by appropriately controlling the amount of resin extruded for the colored layer. Naturally, the thicker the colored second layer is, the deeper the color. In FIG. 2, the colored second layer has a wall thickness gradually reducing from the top, 12, toward the bottom, 14, while the first layer, 16, has a substantially constant thickness.

Figure 3:
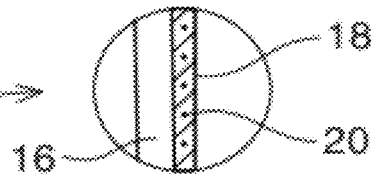
FIG. 3 is a magnified view in FIG. 2 at an upper part 2A.

FIG. 3 is a magnified view in FIG. 2, at an upper part 2A. The container, 20, is a bi-layer structure containing a first layer, 16, inside and a second layer, 18, outside. The second layer, 18, is superposed with a part of the first layer, 16.

Figure 4:
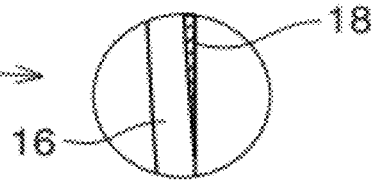
FIG. 4 is a magnified view of FIG. 2 at a lower part, 2B.

FIG. 4 is a magnified view of FIG. 2, at a lower part 2B clearly showing that the thickness of the second layer, 18, gradually decreases from the top, 12, toward the bottom, 14 (see FIG. 2). The second layer, 18, ceases before the bottom, 14.

Figure 5:
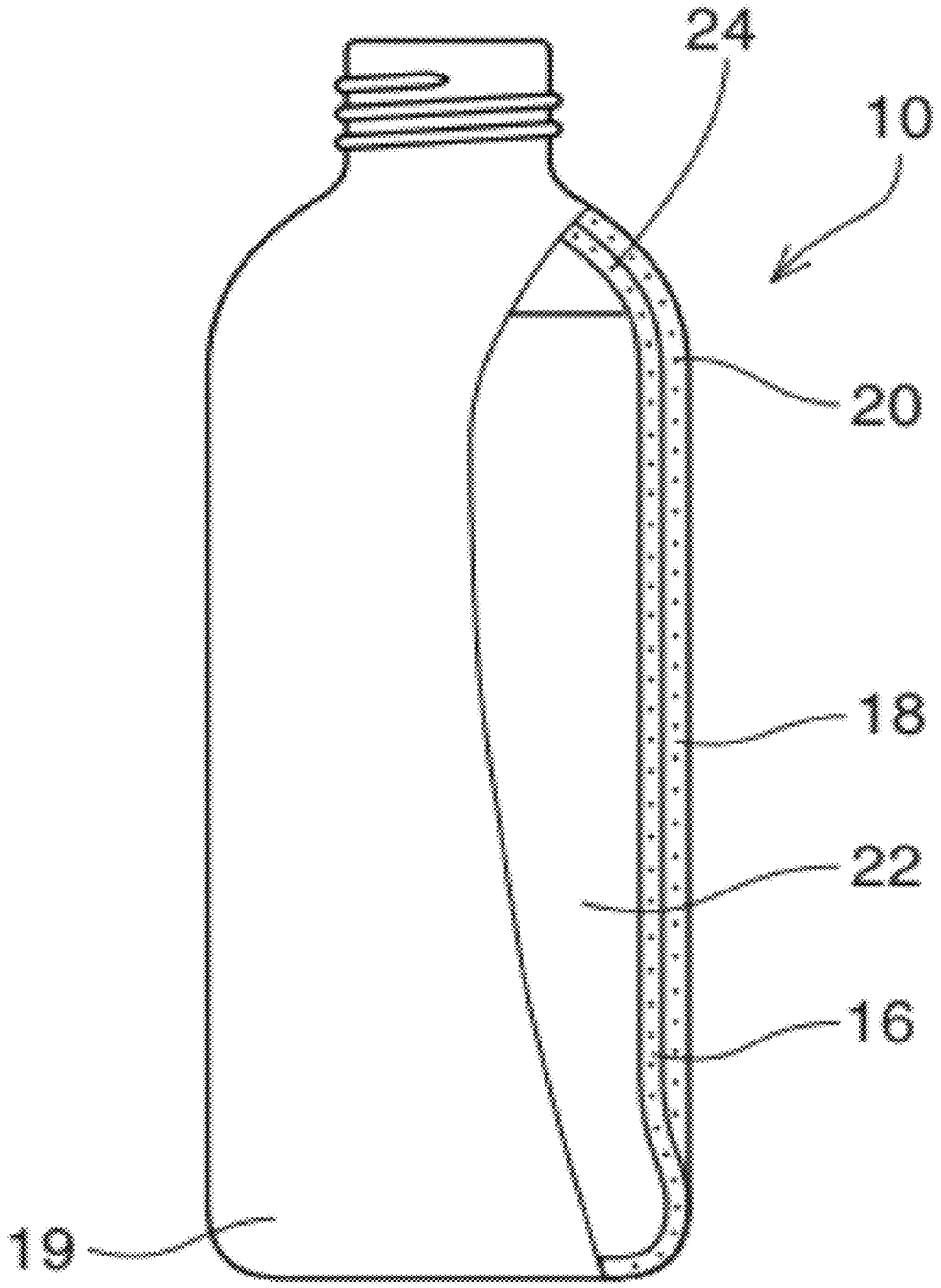
FIG. 5 is a partially cut-away side view of a packaged product according to the present invention.

FIG. 5 is a partially cut-away side view of a packaged product according to the present invention. FIG. 5 illustrates a bi-layer container whose two layers are both non-opaque. The container, 10, has a first layer, 16, and a second layer, 18.

The first layer, 16, is a non-opaque layer and the second layer, 18, is also a non-opaque layer. The second layer, 18, contains a blocking agent, 20. In this embodiment, the first layer, 16, is covered by the second layer, 18. The combination of two non-opaque layers, provides an aesthetic benefit. Also, the container, 10, contains a light-sensitive liquid composition, 22. The light-sensitive liquid composition, 22, is protected from light radiation. As both the first layer, 16, and the second layer, 18, are non-opaque, the light-sensitive liquid composition, 22, in the container, 10, can be seen from outside. Although the first layer, 16, and the second layer, 18, are non-opaque, the blocking agent, 20, is a UV absorbent agent in the second layer, 18, and protects the light-sensitive liquid composition, 22, from external UV light.

The container, 10, may sometimes allow gas transmission through its wall or oxygen gas may enter from the open top of the container, 10. Without intending to be bound by theory, it is believed that for example, oxygen reacts with certain kinds of active components contained in the liquid composition, 22 (i.e., oxidation). Therefore, in the embodiment of FIG. 5, the first layer, 16, inside, is non-opaque, and contains an oxygen gas scavenger, 24, inside. The second layer, 18, is superposed outside of a part of the first layer, 16. The container, 10, contains a liquid composition, 22, inside. The first layer, 16, inside, may react to oxygen gas contained in the liquid composition, 22. The oxygen gas scavenger, 24 may therefore protect the liquid composition, 22 from oxidation caused by oxygen gas.

An "oxygen gas scavenger" may be any material which can remove oxygen from the interior of a closed container either by reacting or combining with the entrapped oxygen, or by promoting an oxidation reaction which yields innocuous products. The oxygen gas scavenger can be mixed with the thermoplastic material before molding, or may be added on the surface of the molded thermoplastic container. Oxygen gas scavengers useful herein include, for example, Oxygard (a polymer containing about 75% polyolefin and 25% reduced iron—see U.S. Pat. No. 5,153,038 to C'oyama); any of the metal-catalyzed oxidative organic polymers described in U.S. Pat. Nos. 5,239,016 and 5,021,515 to Cochran et al., and WO 90/00504 to Frandsen et al.; or the amino olycarboxcylic acid chelate or complexes of a transition metal, or salt thereof described in U.S. Pat. No. 5,202,052 to Zenner et al. Also included within the term "oxygen gas scavenger" are "anti-oxidants". Examples include phosphite anti-oxidants, and phenolic anti-oxidants. More specifically, Ultranox 626 is a phosphite anti-oxidant sold by G.E. Specialty Chemicals, Parkersburg, W.V. which is a bis(2,4-di-tert-butylphenyl) pentaerythritol diphosphite.

Figure 6:
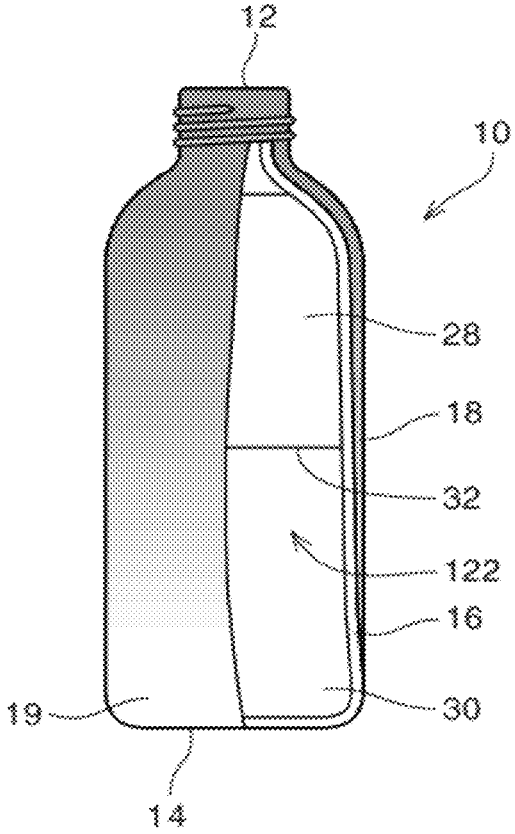
FIG. 6 is a partially cut-away side view of a packaged product according to the present invention.

FIG. 6 is an alternate embodiment of the present invention containing a dual-phase liquid composition, 122, inside. The dual-phase liquid composition, 122, contains an upper phase, 28, and a lower phase, 30, which are substantially separated at a border, 32, and hardly intermingle with each other when the container is motionless. In one embodiment, the upper phase, 28. is an organic phase (e.g., when the organic phase contains light hydrophobic solvents such as ethyl acetate, hexane, petroleum ether, etc.) and the lower phase, 30, is an aqueous phase. In another embodiment, the upper phase is an aqueous phase (high ClogP value) and the lower phase is an organic phase (low ClogP value) (e.g., when the organic phase contains heavy hydrophobic solvents). The ClogP difference between the aqueous phase and the organic phase may be more than about 4.0, about 3.0 or about 2.0, and less than about 7.0, about 6.0 or about 5.0. The container herein may be shaken so that the two layers are mixed up immediately before use. They may be temporarily mixed to each other, but typically, after a period of time such as from about 5 minutes to about 1 hour, the dual-phase liquid product substantially separates into 2 phases.

The ratio between the upper phase, 28, and the lower phase, 30, may be from about 90:10 to about 10:90 by volume, from about 85:15 to about 15:85, or from about 80:20 to about 20:80.

In this instance, the light-sensitive compound may be present in the upper phase, as this phase will be better protected from external light and radiation.

In this instance, the dual-phase liquid composition contains an upper phase, 28, and a lower phase, 30. As the color of the lower part, 10B, of the container, 10, is lighter than that of the upper part, 10A, of the container, 10, the lower phase, 30, may be better seen from the outside. Then the color of the light-sensitive liquid composition can be seen from the outside. Then users do not need to open the package or actually dosing the composition out of the package.

In addition, the container may further contain a soft material around the outer layer. The soft material may be rubber, a soft plastic, a foam, and the like. The soft material may be provided on a part which contacts other containers when a plurality of containers are placed, for example, in a cardboard box or on a shelf. Such a soft material may be a tough and scuff-resistant region in areas where bottles will come in contact with conveyor rails, each other during shipping, handling, and the like, for example, a band around the bottle at the critical locations like the widest portion of the bottle, handles, etc. Furthermore, such a soft material may make it easier for a consumer to grab the container when in use.

The container herein may contain one or more layers in addition to the first layer and the second layer. Such an extra layer may be superposed with the first layer and/or the second layer, partially or entirely. The extra layer may be non-opaque or opaque, more preferably, non-opaque.

Figure 7:
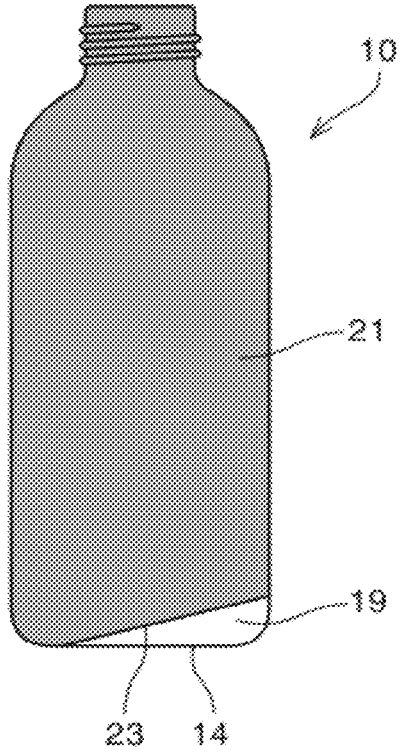
FIG. 7 is a side view of an alternate embodiment of the present invention.

FIG. 7 illustrates another embodiment of the present invention. The container, 20, has a non-superposed area, 19 and a superposed area, 21. In the superposed area, the first layer and the second layer are superposed to each other. The container has a border line between the non-superposed area and the superposed area. The border line, 23, is not horizontal (i.e., substantially parallel to the bottom, 14) but obliquely runs to the bottom. In this embodiment, part of the superposed area extends from the top to the bottom, and part of the superposed area ends halfway, leaving a non-superposed area at the bottom. The light-sensitive ingredient in the formula is protected from light and part of the inside is viewed from the outside, too.

EXAMPLE

Haze Test

Haze is the scattering of light by a substrate that results in a cloudy appearance or poorer clarity of objects when viewed through the substrate. More specifically, haze is the percentage of light transmitted through a substrate that is deflected more than 2.5% (degrees) from the direction of the incoming beam. This property is used to describe transparent and translucent materials, not opaque ones. Haze of the first layer is measured in accordance with ASTM-D1003-00, procedure A (Hazemeter), using haze gard dual AT-4727 (BYK-Gardner, Inc.). The specimen is illuminated by a substantially unidirectional beam; the maximum angle that any ray of this beam may make with the beam axis does not exceed 0.05 rad. This beam is not vignetted at either of the sphere's ports. When the specimen is placed against the entrance port of the integrating sphere, the angle between the perpendicular to the specimen and a line connecting the centers of entrance and exit ports will not exceed 0.14 rad. When the beam is unobstructed by a specimen, its cross section at the exit port will be approximately circular, sharply defined, and concentric within the exit port, leaving an annulus of 0.023±0.002 rad subtended at the entrance port. A light trap absorbs the beam completely when no specimen is present, or the instrument design obviates the need for a light trap. Four readings are taken, and the haze value is calculated by the following equations.

| Reading Designation | Specimen in Position | Light Trap in Position | Reflectance Standard in Position | Quantity Represented |
|---|---|---|---|---|
| $T_1$ | no | no | yes | Incident light |
| $T_2$ | yes | no | yes | Total light transmitted by specimen |
| $T_3$ | no | yes | no | Light scattered by instrument |
| $T_4$ | yes | yes | no | Light scattered by instrument and specimen |

Calculate total transmittance, $T_t$: $T_t=T_2/T_1$,
Calculate diffuse transmittance, $T_d$: $T_d=[T_4-T_3(T_2T_1)]T_1$
Calculate percent haze: haze$=T_d/T_t\times100$ Method for Manufacture The container herein may be manufactured by blow molding or injection molding a parison provided by co-extruding of separate resins for the first layer and for the second layer.

When a pigment is contained only in the second layer, the total amount of the colorant to be used for the container can be reduced. This may provide benefits of reducing the amount of colorant in the manufacturing the bottle.

In one instance, injection stretch blow molding (ISBM) or injection blow molding (IBM) may be used. For example, ISBM is carried out as follows. First, the preforms are injected, and the molding procedure uses hot runner technology to improve the service efficiency of raw materials (injection molding). Second, the preforms are moved together with the heat-retaining mold cores to the stretch blowing mold, and then high pressure compressed air is blown into the inside of the preform to form a final container shape (stretch blow molding). Third, the finished containers are ejected from the ISBM mold.

It is understood that the examples and embodiments described herein are for illustrative purpose only and that various modifications or changes will be suggested to one skilled in the art without departing from the scope of the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A packaged product comprising:

A) a plastic container for protecting a light-sensitive liquid composition from light comprising:

i) a top;

ii) a bottom of the container opposing to the top and a sidewall extending between the top and the bottom of the container;

iii) a first layer extending from the top to the bottom of the container, wherein the first layer is non-opaque; and iv) a second layer superposed with a part of the first layer forming a superposed area, wherein the second layer comprises a blocking agent;

wherein the container comprises a non-superposed area covering a bottom of the sidewall, where the first layer is not superposed with the second layer, the non-superposed area extends from the bottom of the container to a height h on the sidewall of from about 2 mm to about 50 mm; and B) a light-sensitive composition contained in the plastic container, wherein the light-sensitive composition is sensitive to light of a wavelength λ, and where in the blocking agent blocks light of the wavelength λ.

2. The packaged product according to claim 1, wherein the container extends in a height direction from the top to the bottom, wherein the second layer comprises a second layer thickness, and wherein the second layer thickness gradually decreases from the top to the bottom in the height direction.

3. The packaged product according to claim 1, wherein the first layer is an inner layer and the second layer is an outer layer.

4. The packaged product according to claim 1, wherein the first layer is an outer layer and the second layer is the inner layer.

5. The packaged product according to claim 1, wherein the liquid product is a dual-phase liquid product.

6. The packaged product according to claim 1, wherein the first layer is selected from the group consisting of transparent, translucent, pigmented and a mixture thereof.

7. The packaged product according to claim 1, wherein the first layer has a Haze value of between from about 0.1% to about 85%, measured in accordance with ASTM-D1003-00.

8. The packaged product according to claim 1, wherein the blocking agent is selected from the group consisting of a UV blocking agent, a visible light blocking agent and a mixture thereof.

9. The packaged product according to claim 1, wherein the first layer and the second layer comprise a plastic material selected from the group consisting of polypropylene, polyethylene, polystyrene, polyethylene terephthalate, a polyacryl resin, a polyamide resin, a polyvinylchloride resin, an acrylate resin, an ABS resin, an ethylene vinyl alcohol copolymer resin, a nylon resin, a polyvinylidene chloride resin, and a mixture thereof.

10. The packaged product according to claim 3, wherein the outer layer comprises a regenerated resin.

11. The packaged product according to claims 3, wherein the container comprises an oxygen gas scavenger in the inner layer.

12. The packaged product according to claims 4, wherein the container comprises an oxygen gas scavenger in the inner layer.

13. The packaged product according to claim 1, wherein the light-sensitive composition comprises an ingredient selected from the group consisting of an enzyme, a bleach, a fabric softening active, and a mixture thereof.

14. The packaged product according to claim 1, wherein the container comprises a border line between the non-superposed area and the superposed area, and wherein the border line obliquely runs to the bottom.

* * * * *